US012134491B2

(12) United States Patent
Deutschle et al.

(10) Patent No.: US 12,134,491 B2
(45) Date of Patent: Nov. 5, 2024

(54) METHOD AND DEVICE FOR FLEXIBLY TREATING PHARMACEUTICAL PACKAGES

(71) Applicants: SCHOTT Pharma AG & Co., KGaA, Mainz (DE); SCHOTT Pharma Schweiz AG, St. Gallen (CH)

(72) Inventors: Gregor Fritz Deutschle, Idstein (DE); Anil Kumar Busimi, St. Gallen (CH); Bertram Kimmerle, Widnau (CH); Arne Kloke, St. Gallen (CH); Fabian Stöcker, Usingen (DE)

(73) Assignees: SCHOTT Pharma AG & Co. KGaA, Mainz (DE); SCHOTT Pharma Schweiz AG, St. Gallen (CH)

( * ) Notice: Subject to any disclaimer, the term of this patent is extended or adjusted under 35 U.S.C. 154(b) by 0 days.

(21) Appl. No.: 17/831,039

(22) Filed: Jun. 2, 2022

(65) Prior Publication Data

US 2022/0380070 A1 Dec. 1, 2022

Related U.S. Application Data

(60) Division of application No. 16/853,178, filed on Apr. 20, 2020, now abandoned, which is a continuation of (Continued)

(30) Foreign Application Priority Data

Oct. 24, 2017 (DE) ..... 10 2017 124 908.7

(51) Int. Cl.
*B65B 5/06* (2006.01)
*B65B 3/00* (2006.01)

(Continued)

(52) U.S. Cl.
CPC ..... *B65B 3/003* (2013.01); *B65B 5/067* (2013.01); *B65B 5/068* (2013.01); *B65B 55/025* (2013.01);

(Continued)

(58) Field of Classification Search
None
See application file for complete search history.

(56) References Cited

U.S. PATENT DOCUMENTS 6,418,982 B1 * 7/2002 Zhang ..... B65B 31/025 141/2
8,100,263 B2 1/2012 Vanderbush et al.

(Continued)

FOREIGN PATENT DOCUMENTS

CN 2563122 Y 7/2003
DE 10 2010 039 635 A1 2/2012

(Continued)

OTHER PUBLICATIONS

Notification of the Transmission of the International Search Report and Written Opinion of the International Search Authority or Declaration dated Apr. 10, 2019 for International Application No. PCT/EP2018/079026 (24 pages).

(Continued)

*Primary Examiner* — Chinyere J Rushing-Tucker
(74) *Attorney, Agent, or Firm* — Taylor IP, P.C.

(57) ABSTRACT

A method of filling pharmaceutical containers includes: filling a first plurality of containers, the first plurality of containers being supported by a first holder supported on a first step of a first transport and packaging container defining a first step height, the filling includes moving filling needles of a filling device to a filling needle height and dispensing a substance into each of the first plurality of containers; and filling a second plurality of containers, the second plurality (Continued)

of containers being supported by a second holder supported on a second step of a second transport and packaging container defining a second step height equal to the first step height, the filling includes moving the filling needles to the filling needle height and dispensing the substance into each of the second plurality of containers, the second plurality of containers differ from the first plurality of containers in at least one aspect.

20 Claims, 11 Drawing Sheets

Related U.S. Application Data application No. PCT/EP2018/079026, filed on Oct. 23, 2018.

(51) Int. Cl.

| | |
|---|---|
| ***B65B 55/02*** | (2006.01) |
| ***B65B 55/08*** | (2006.01) |
| ***B65B 59/00*** | (2006.01) |
| *B65D 77/04* | (2006.01) |

(52) U.S. Cl.

CPC ..... *B65B 55/08* (2013.01); *B65B 59/003* (2019.05); *B65D 77/0446* (2013.01)

(56) References Cited

U.S. PATENT DOCUMENTS

| | | | | |
|---|---|---|---|---|
| 8,118,167 | B2 | 2/2012 | Togashi et al. | |
| 8,360,238 | B2 | 1/2013 | Nicoletti | |
| 10,336,479 | B2 | 7/2019 | Deutschle et al. | |
| 10,669,049 | B2 | 6/2020 | Eberhardt et al. | |
| 2005/0194059 | A1* | 9/2005 | Py | B65B 65/02 141/18 |
| 2008/0184671 | A1* | 8/2008 | Fleckenstein | B65B 39/12 53/268 |
| 2009/0100802 | A1* | 4/2009 | Bush | A61M 5/002 53/434 |
| 2011/0277419 | A1 | 11/2011 | Nicoletti | |
| 2014/0027333 | A1 | 1/2014 | Pawlowski et al. | |
| 2014/0374414 | A1* | 12/2014 | Lanier | A61J 1/16 220/23.6 |
| 2015/0089830 | A1* | 4/2015 | Wissner | B65B 7/2892 34/92 |
| 2015/0122693 | A1 | 5/2015 | Deutschle et al. | |
| 2015/0166212 | A1 | 6/2015 | Wissner et al. | |
| 2016/0318660 | A1 | 11/2016 | Wissner et al. | |
| 2017/0183113 | A1* | 6/2017 | Deutschle | G01G 17/06 |
| 2018/0126066 | A1 | 5/2018 | Narvekar et al. | |
| 2018/0208377 | A1* | 7/2018 | Kloke | B65B 3/003 |

FOREIGN PATENT DOCUMENTS

| | | | |
|---|---|---|---|
| EP | 2 848 882 | A1 | 3/2015 |
| WO | 2016/135051 | A1 | 9/2016 |
| WO | 2016/166765 | A1 | 10/2016 |
| WO | 2016/166769 | A1 | 10/2016 |

OTHER PUBLICATIONS

Chinese Office Action dated Apr. 2, 2021 for Chinese Application No. 201880069190.9 (17 pages).

European Communication dated Jul. 20, 2021 for European Patent Application No. 18 799 682.2 (3 pages).

Chinese Office Action, including an English translation, dated Oct. 27, 2021 for Chinese Patent Application No. 201880069190.9 (28 pages).

Indian Office Action dated Feb. 23, 2022 for Indian Application No. 202017014755 (6 pages).

Chinese Office Action dated Jun. 7, 2022 for Chinese Patent Application No. 201880069190.9 (5 pages).

English translation of Chinese Office Action dated Jun. 7, 2022 for Chinese Patent Application No. 201880069190.9 (5 pages).

* cited by examiner

METHOD AND DEVICE FOR FLEXIBLY TREATING PHARMACEUTICAL PACKAGES

CROSS REFERENCE TO RELATED APPLICATIONS

This is a division of U.S. patent application Ser. No. 16/853,178, entitled "METHOD AND DEVICE FOR FLEXIBLY TREATING PHARMACEUTICAL PACKAGES," filed Apr. 20, 2020, which is incorporated herein by reference. U.S. patent application Ser. No. 16/853,178 is a continuation of PCT application no. PCT/EP2018/079026, entitled "METHOD AND DEVICE FOR FLEXIBALLY TREATING PHARMACEUTICAL PACKAGES", filed Oct. 23, 2018, which is incorporated herein by reference. PCT application no. PCT/EP2018/079026 claims the priority of German patent application no. 10 2017 124 908.7 entitled "Method and device for flexibly treating pharmaceutical packages", filed on Oct. 24, 2017, which is incorporated herein by reference.

BACKGROUND OF THE INVENTION

1. Field of the Invention

The present invention relates in general to a method and a device for treating or processing pharmaceutical packages, and to a method and a device for flexibly treating or processing a plurality of pharmaceutical packages of different types using a transport and packaging container of standard design without complicated retooling or reprogramming measures being required in order to treat or to process a different type of pharmaceutical package.

2. Description of the Related Art

Containers used for storing medical, pharmaceutical or cosmetic preparations for administration in liquid, solid, or powder form, in particular in predosed amounts, are, to a large extent, medicament containers, such as vials, cartridges, or syringes. These generally have a cylindrical shape, can be produced from plastic or from glass, and are obtainable cost effectively in large quantities. For as economical a filling of the containers as possible under sterile conditions, use is increasingly made of concepts in which the containers are packaged in sterile form in transport and packaging containers directly at the manufacturer of the containers and are then unpacked at a pharmaceutical company under sterile conditions, in particular in what is referred to as a sterile tunnel or in a clean room, and are then further processed. With such nested packaging concepts, the containers do not need first to be washed, dried and sterilized in a complicated manner at the pharmaceutical company.

For this purpose, the prior art has disclosed various transport and packaging containers (what are referred to as "tubs") in which a plurality of medicament containers are simultaneously arranged on a support (what is referred to as a "nest") in a regular arrangement, for example in a matrix arrangement, along rows and columns extending at right angles thereto. Such nested solutions have advantages in the automated further processing of the containers because the containers can be transferred at controlled positions and in a predetermined arrangement to processing stations, for example to automatic processing machines, robots or the like. For this purpose, use is made of holding structures in which a plurality of containers can be held simultaneously in a predetermined regular arrangement. All that is needed for the transfer to a processing station is for the transport and packaging container to simply be positioned suitably and opened. The downstream processing station then knows in which position and arrangement the containers which are to be processed further are arranged.

Such a transport and packaging container and a corresponding packaging concept are disclosed, for example, in U.S. Pat. No. 8,118,167 B2. However, the further processing of the containers always takes place in such a manner that the holding structure from the transport and packaging container, the containers are removed from the holding structure and separated and, on a conveyor device, in particular a conveyor belt, are transferred individually to the processing stations and processed further there. The separating of the containers with the aid of star wheels or the like limits the speed which can be achieved during the further processing and may lead to undesirable abrasion and, in consequence, to contamination of the container interior or of the process system and to an adverse effect on the external appearance and/or structural integrity of the containers, which is undesirable.

U.S. Pat. No. 8,100,263 B2 discloses a transport and packaging container which can be packaged and transported in a sterile manner and into which a plate like holding structure can be inserted, in which a plurality of medicament containers are held in a regular arrangement. The individual medicament containers are initially arranged loosely in receptacles which are formed in the holding structure. The holding structure is subsequently inserted into the transport and packaging container and the latter is surrounded with a gas impermeable plastic tube. During subsequent evacuation of the packaging unit formed in such a manner, the plastic tube is pressed by the negative pressure prevailing in the tube into the intermediate spaces between the medicament containers, which thus firstly leads to stabilization of the position of the medicament containers in the holding structure and secondly prevents a further uncontrolled collision between adjacent medicament containers. However, during the evacuation and during the subsequent opening of the plastic tube, the medicament containers can slip laterally, which increases the outlay on automation for further processing the medicament containers. Furthermore, after the opening of the plastic tube, the medicament containers can nevertheless collide in an uncontrolled manner, which brings the aforementioned disadvantages therewith. The medicament containers cannot be further processed in the transport or packaging container or in the holding structure but rather first of all have to be separated in the conventional manner and transferred to downstream processing stations.

Before the medicament containers in nested packaging concepts can be treated or further processed in a clean room or a controlled environment, a series of preliminary measures are required, such as, for example, the opening of a sterile packaging unit in which the transport and packaging containers are packaged and transport into the clean room or the controlled environment. For this purpose, handling devices have to be configured and adjusted in a manner specially coordinated with the respective dimensions of the respective transport and packaging container, which is complicated.

Specifically for high quality medicaments, for example for gene therapy, it may be necessary to store person specific active substances, depending on the respective administration form, in containers having different dimensions or of a different type. When the life cycle of a medicament is considered, medicaments when introduced onto the market are frequently initially stored and sold in containers of a first type, for example in vials, and, in a later phase for the mass market, are then frequently stored and sold in containers of a different type, for example in cartridges, for example for self-administration by injection pens or the like.

This makes the treatment and processing of containers complicated because, conventionally, the process systems have to be newly configured, documented and possibly certified depending on the type of container.

SUMMARY OF THE INVENTION

In some exemplary embodiments, a method for treating or processing containers for storing substances for medical, pharmaceutical or cosmetic uses or contain said substances is provided. The method comprises: providing a plurality of transport and packaging containers which each accommodate a respective support on which a plurality of containers is held, the transport and packaging containers being of box shaped design and are packaged in a packaging unit, the containers are held on the respective supports in such a manner that the respective supports are completely accommodated in the transport and packaging containers without upper ends of the containers protruding over an upper edge of the transport and packaging containers; opening the packaging unit; conveying the transport and packaging containers with a conveyor device to a processing station; and treating or processing the containers in the processing station. The treatment or processing of the containers in the processing station includes at least filling the containers with a substance for medical, pharmaceutical or cosmetic uses. Containers of a different container type, selected from a group consisting of vials, cartridges, and syringes, or containers having at least one of different sizes or different nominal volumes are treated or processed. At least one of an overall height of the transport and packaging containers or a height of a step close to the upper edge of the transport and packaging container is always constant irrespective of: a) the container type of the containers held on the respective supports; or b) at least one of the sizes or the nominal volumes of the containers held on the respective supports.

In some exemplary embodiments provided according to the present invention, a transport and packaging container for a plurality of containers which serve for storing substances for medical, pharmaceutical or cosmetic uses or contain said substances is provided. The transport and packaging container is of box shaped design and has an upper edge, an introduction opening for the introduction of the containers into the transport and packaging container is formed on the upper edge of the respective transport and packaging container and is covered by a protective film, the transport and packaging container accommodating a support on which the plurality of containers is held such that the plurality of containers is accommodated in packaged form in the transport and packaging container. The overall height of the transport and packaging container is within a range of between 51 mm and 97 mm and a plurality of cartridges, syringes, or vials is held on the support in the transport and packaging container.

In some exemplary embodiments provided according to the present invention, a device for treating or processing containers which serve for storing substances for medical, pharmaceutical or cosmetic uses or contain said substances is provided. The device includes: a processing station in which the containers are treated or processed, the processing station being configured to fill the containers with a substance for medical, pharmaceutical or cosmetic uses; a conveyor device configured to convey the transport and packaging containers to the processing station; and a supply section which is arranged upstream of the processing station and is configured to provide a plurality of transport and packaging containers which accommodate a respective support on which a plurality of containers is held. The transport and packaging containers are of box shaped design and packaged in a packaging unit, the containers being held on the respective supports in such a manner that the respective supports are completely accommodated in the transport and packaging containers without upper ends of the containers protruding over an upper edge of the transport and packaging containers. The supply section has an opening section for opening the packaging unit, the device is configured in such a manner that containers of different container type selected from the group consisting of vials, cartridges, and syringes are processable or treatable as containers which are held on the respective supports without a height adjustment of components of the device being required, and therefore, irrespective of the container type of the containers held on the respective supports, at least one of an overall height of the transport and packaging containers or a height of a step close to the upper edge of the transport and packaging containers is constant.

In some exemplary embodiments provided according to the present invention, a package for holding pharmaceutical containers on a filling line includes: a transport and packaging container having a plurality of connected sidewalls, a base, an upper edge opposite the base, and a step defining a step height that is constant relative to the upper edge and less than an overall height defined between the upper edge and the base; and a holder placed in the transport and packaging container and having a plurality of holder openings formed therein. The holder is supported on the step and configured to hold a container in each of the holder openings so the held containers are suspended within the transport and packaging container. The step height is constant and independent of at least one of a shape, a type, or a size of each of the held containers.

In some exemplary embodiments provided according to the present invention, a package for holding pharmaceutical containers on a filling line includes: a transport and packaging container having a plurality of connected sidewalls, a base, an upper edge opposite the base, and a step placed between a pair of the sidewalls, the step defining a constant distance from the upper edge, the upper edge and the base defining an overall height therebetween; and a holder placed in the transport and packaging container and having a plurality of holder openings formed therein. The holder is supported on the step and configured to hold a container in each of the holder openings so the held containers are suspended within the transport and packaging container with an upper end of each of the held containers at a set height that is controlled by the constant distance to be less than the overall height and is independent of at least one of a shape, a type, or a size of each of the held containers.

In some exemplary embodiments provided according to the present invention, a method of filling pharmaceutical containers includes: filling a first plurality of containers with a filling device, the first plurality of containers being supported by a first holder supported on a first step of a first transport and packaging container, the first step defining a first step height, the filling includes moving a plurality of filling needles of the filling device to a filling needle height and dispensing a substance from the filling needles into each of the first plurality of containers; and filling a second plurality of containers with the filling device, the second plurality of containers being supported by a second holder supported on a second step of a second transport and packaging container, the second step defining a second step height that is equal to the first step height, the filling includes moving the filling needles to the filling needle height and dispensing the substance from the filling needles into each of the second plurality of containers, the second plurality of containers differing from the first plurality of containers in at least one aspect including at least one of a size, a shape, or a type.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
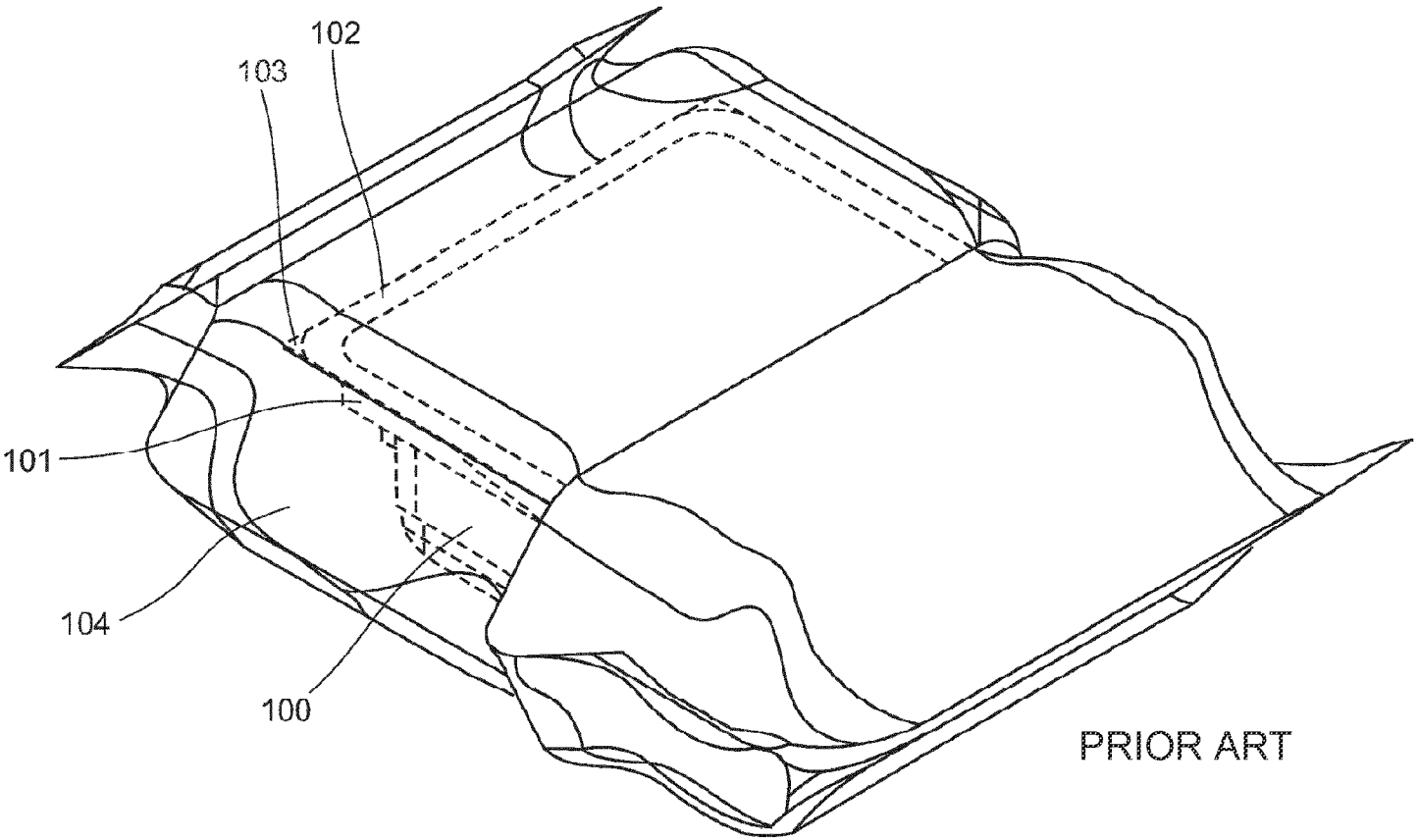
PRIOR ART FIG. 1
FIG. 1 illustrates a packaging unit with a transport and packaging container provided according to the prior art.

Referring now to FIG. 1, a packaging unit with a transport and packaging container 100 provided according to the prior art is illustrated. Adhesively bonded onto the upper edge 102 of the transport and packaging container 100 is a protective film 103, in particular a sterile protective film, for example a gas permeable protective film, which permits sterilization of the interior of the transport and packaging container 100 through the protective film 103.

Figure 2:
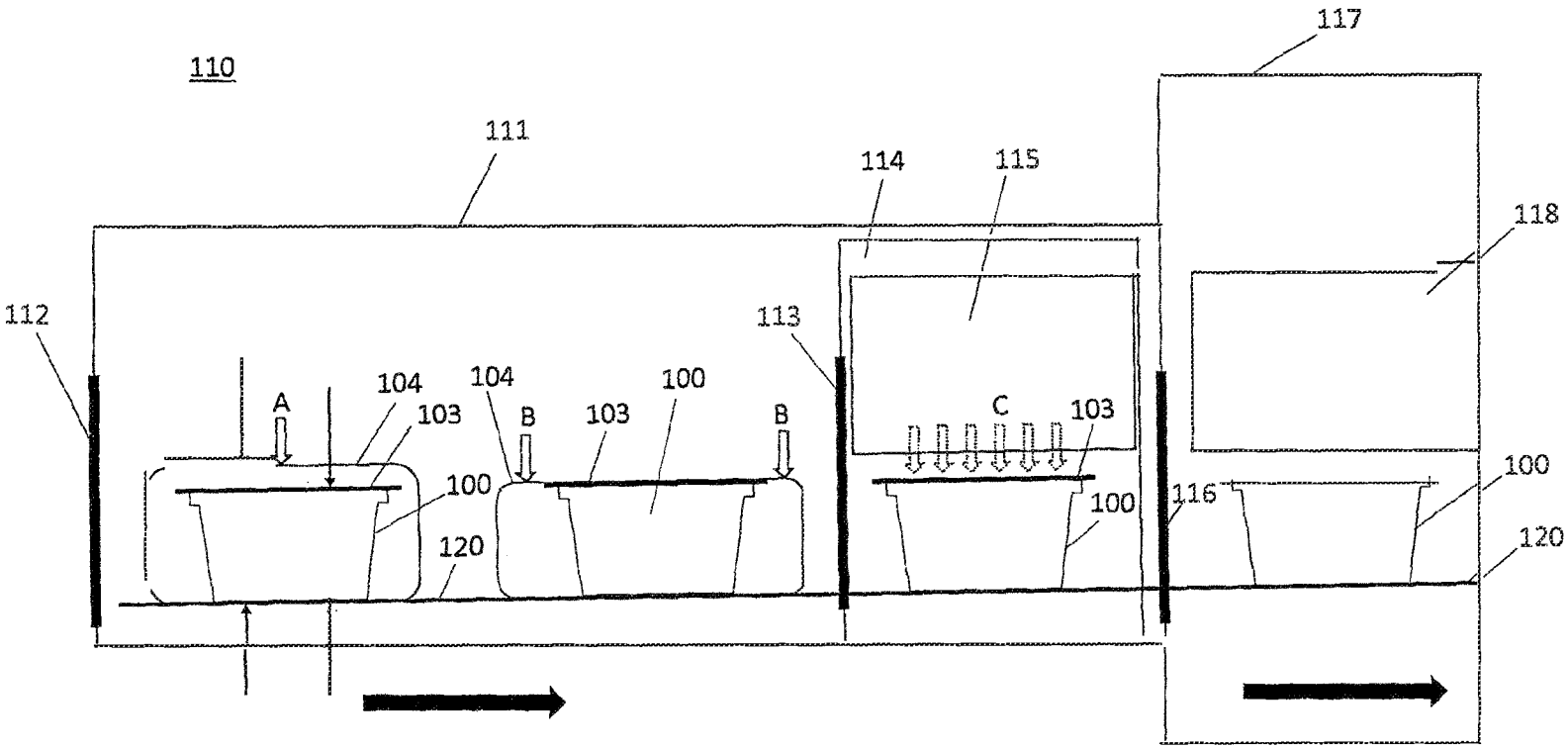
PRIOR ART FIG. 2
FIG. 2 illustrates a schematic illustration of the treatment and processing of a plurality of containers in a nested packaging concept according to the prior art.

So that containers which are packaged in a sterile manner in such a packaging unit can be further processed, use is conventionally made according to the prior art of a process system 110 as illustrated schematically by way of example in FIG. 2.

The packaging bags 104 made of plastic are introduced via a material lock 112 into an anteroom 111, which can already be a clean room, for example a clean room of a low clean room class. The packaging bags 104 are placed onto a conveyor device 120, for example onto a transport belt, and conveyed in the direction specified by the arrow toward the clean room 117. Since the transport and packaging container 100 is accommodated loosely in the packaging bag 104, first of all in station A the upper side of the packaging bag 104 has to be pressed down such that the plastic of the packaging bag 104 rests directly on the sterile protective film 103 or on the upper edge of the transport and packaging container 100. The packaging bag 104 is then slit open at the positions B and the transport and packaging container 100 is introduced via the material lock 113 into a decontamination region 114 in which the outer side of the transport and packaging container 100, in particular the region of the protective film 103, is freed from germs, etc. by a decontamination device 115, for example by electron beams. The transport and packaging container 100 is subsequently transferred via a further material lock 116 into the clean room 117 in which, after removal of the protective film, the containers which, in a nested packaging concept, are held on a support (not shown), which is accommodated in the transport and packaging container 100, are actually further treated or processed.

The decontamination of the outer side of the transport and packaging container 100 in the decontamination region 114 is especially dependent on spacing and geometry and requires precise coordination with the geometry, in particular the height of the respectively supplied transport and packaging container 100.

However, according to the prior art, different types of pharmaceutical packages require transport and packaging containers having different geometries and dimensions, in particular having different overall heights. The height of a transport and packaging container for a nested packaging concept for vials is thus conventionally different from a nested packaging concept for cartridges or syringes. Even for pharmaceutical packages of the same type but for different nominal volumes, conventionally, in the case of a nested packaging concept, use is always made of transport and packaging containers having different geometries and dimensions, in particular different overall heights. This makes the treatment and further processing of the pharmaceutical packages complicated.

In a process system according to the prior art, as is illustrated in FIG. 2, the transport and packaging containers have to be precisely guided laterally and/or vertically so that the positions of the individual containers which are each held on a support are precisely predetermined and in particular filling needles or the like for filling the containers are not damaged or displaced by collision with the upper ends of the containers. Particular importance is attached here to the height position of the containers held on the support. Only if the upper ends of the containers held on the support are arranged with the filling openings provided there at the same height level can a collision of the upper ends with filling needles or the like for filling the containers be reliably prevented even without complicated readjustment of the height positions of the filling needles or the like.

Figure 3B:
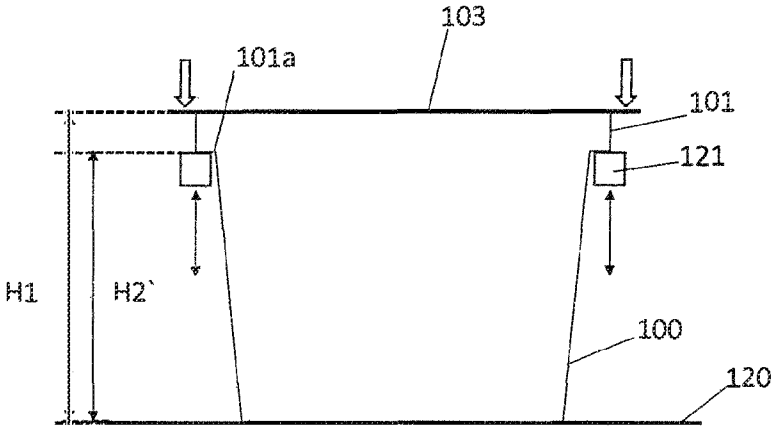
FIG. 3B PRIOR ART
FIGS. 3A and 3B illustrate details of a guide of a transport and packaging container having different external dimensions in a nested packaging concept according to the prior art.
Figure 3A:
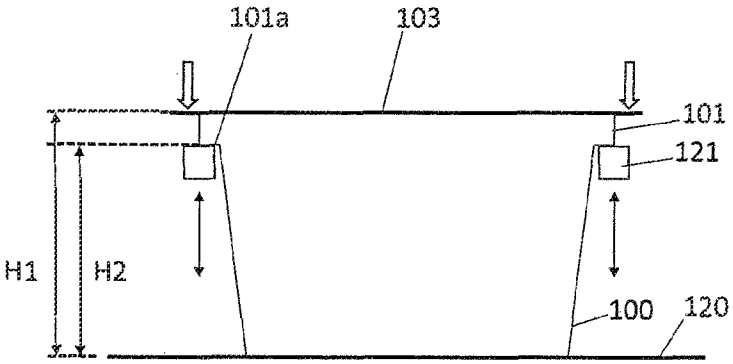
FIG. 3A PRIOR ART

This is illustrated by way of example in FIGS. 3A and 3B for two box shaped transport and packaging containers 100 having different overall heights H1. At the upper end of the transport and packaging container 100, a step 101*a* is conventionally formed below the upper side wall 101. Strip like guides 121 are provided above the transport belt 120 and bring about guidance of the transport and packaging container 100 on the transport belt by interaction with a lower side wall of the transport and packaging container or by the step 101*a* resting on the guide 121. FIG. 3A depicts the geometrical ratios for a first transport and packaging container 100 having an overall height H1 and a height H2 of the step 101*a* above the transport belt 120. FIG. 3B depicts the geometrical ratios for a second transport and packaging container 100 having a different overall height H1' and a different height H2' of the step 101*a* above the transport belt 120. If transport and packaging containers 100 having different geometries and/or heights are intended to be further processed, a complicated readjustment of the entire process system may be required, which is complicated and makes flexible further processing of pharmaceutical packages of different types and/or dimensions or nominal volumes impossible.

To address some of the previously described issues, exemplary embodiments disclosed herein provide an improved method and an improved device for treating or processing containers (in general, pharmaceutical packages) which serve for storing substances for medical, pharmaceutical or cosmetic uses or contain said substances, with which flexible further processing of pharmaceutical packages of different types and/or dimensions or nominal volumes is made possible.

According to the present invention, a method is provided for treating or processing containers which serve for storing substances for medical, pharmaceutical or cosmetic uses or contain said substances, comprising the following steps: providing a plurality of transport and packaging containers which accommodate a support on which a plurality of containers is held, wherein the transport and packaging containers are of box shaped design and are packaged in a packaging unit; opening the packaging unit; conveying the transport and packaging containers with a conveyor device to a processing station and removing the containers from the transport and packaging containers in the processing station; treating or processing the containers in the processing station, wherein the treatment or processing of the containers in the processing station includes at least filling the containers with a substance for medical, pharmaceutical or cosmetic uses. According to the present invention, optionally either vials, cartridges or syringes can be held as containers on the respective support, wherein an overall height of the transport and packaging containers and/or a height of a step close to an upper edge of the transport and packaging container is constant, specifically a) irrespective of whether vials, cartridges or syringes are held on the respective support, and/or b) irrespective of the sizes and/or nominal volumes of the containers held on the respective support.

Thus, with a transport and packaging container of standard geometry and dimensions, different types of containers or pharmaceutical packages or containers or pharmaceutical packages having different dimensions and/or nominal volumes can be further processed in a controlled environment, in particular in a clean room. This applies in particular to the three exemplary types of pharmaceutical packages described, namely vials, cartridges or syringes. For this purpose, the components of a processing system do not have to be adjusted, reconfigured and validated, which permits a considerable reduction in outlay and costs.

Furthermore, according to the present invention, even pharmaceutical packages having different dimensions, geometries and/or nominal volumes can be further processed using transport and packaging containers having a standard geometry and dimensions.

According to the present invention, the adaptation to the different types, dimensions, geometries, nominal volumes, etc. of the pharmaceutical packages may take place by a suitable different configuration of the respectively used support. During delivery to a pharmaceutical company, the support together with the pharmaceutical packages held thereon is completely accommodated in the transport and packaging container. In particular, the upper ends of the pharmaceutical packages do not protrude above the upper edge of a transport and packaging container, and therefore the latter can be closed in a simple manner by adhesively bonding a protective film, in particular by adhesively bonding a sterile protective film, onto the upper edge. One or more transport and packaging containers are expediently packaged here in a packaging unit which can also be designed as a sterile packaging unit. According to the present invention, the packaging units can therefore be supplied to a pharmaceutical company with standard external dimensions and a standard design but with different pharmaceutical packages stored therein. A pharmaceutical company does not need to undertake any complicated retooling measures for further processing of the pharmaceutical packages, in particular for filling same with a medical active substance. According to some embodiments of the present invention, the transport and packaging containers are, however, closed in a sterile manner by a sterile protective film such that the packaging unit itself does not need to be sterile.

For the adaptation of the geometry of the respective support, in particular the geometry and length of holders for holding the containers on the support or of side walls of the support can be suitably adapted to the respective use, which is possible in a simple manner. For this purpose, the supports adapted to the respective type of containers to be processed or to the respective sizes and/or nominal volumes of the containers to be processed can be stored separately and optionally used for holding the container and introduced into a transport and packaging container.

A further advantage of the use of packaging units or transport and packaging containers having constant external dimensions, in particular constant overall heights, is also that material locks for the transfer into a downstream room of a processing system and decontamination devices can continue to be used without complicated readjustment.

According to some embodiments, upper ends of the containers, at least during the filling of the containers with the substance for medical, pharmaceutical or cosmetic uses, are always arranged at the same height with respect to the conveyor device or with respect to a floor of the processing station, specifically a) irrespective of whether vials, cartridges or syringes are treated and processed, and/or b) irrespective of the sizes and/or nominal volumes of the containers held on the respective support. After removal from the respective packaging unit, the containers can therefore be filled under controlled conditions without a height adjustment of filling needles or the like being required. Damage to the filling needles or the like by the containers of different type or different external dimensions is also effectively prevented.

According to some embodiments, during the conveying of the transport and packaging containers by the conveyor device in the processing station and during a pretreatment for this purpose, in particular a decontamination, the upper ends of the containers are always arranged at the same height with respect to the conveyor device or with respect to a floor of the processing station, specifically a) irrespective of whether vials, cartridges or syringes are treated and processed, and/or b) irrespective of the sizes and/or nominal volumes of the held on the respective support. Consistent conditions for the decontamination or sterilization of the outer side of a transport and packaging container prior to the transfer to a clean room can therefore be ensured even when containers of different type or different external dimensions or nominal volumes are used, without a complicated readjustment of said conditions being required each time.

According to some embodiments, the processing station is arranged in a clean room, after opening of the packaging unit an outer side of the transport and packaging containers is treated in a decontamination region, the transport and packaging containers are subsequently transferred into the clean room, and the containers are removed from the transport and packaging containers in the clean room. Particularly sterile processing conditions for the further processing of the containers can therefore be ensured because the containers are only removed in the clean room itself. Even after the containers are removed from the transport and packaging container, an inlay film can also be placed onto the upper ends of the containers in order also to continue to prevent an undesirable penetration of contaminants into the container.

According to some embodiments, the constant height/geometry of the respectively used transport and packaging container permits lateral and/or vertical guidance of the transport and packaging containers or else supports at least in phases during the treatment or processing of the containers without a complicated readjustment of guide devices and the like being required for this purpose.

A further aspect of the present invention relates to the fact that, in the case of a method for treating or processing containers which serve for storing substances for medical, pharmaceutical or cosmetic uses or contain same, in which a plurality of transport and packaging containers are provided which accommodate a support on which a plurality of containers is held. The transport and packaging containers are of box shaped design and are packaged in a packaging unit, in which the packing unit is opened, in which the transport and packaging container is conveyed by a conveyor device to a processing station and the containers are removed from the transport and packaging containers in the processing station, and in which the treatment or processing of the containers in the processing station comprises at least filling of the containers with a substance for medical, pharmaceutical or cosmetic uses, and in which optionally either vials, cartridges or syringes as containers are held on the respective support, an overall height of the transport and packaging containers and/or a height of a step close to an upper edge of the transport and packaging containers is constant, specifically a) irrespective of whether vials, cartridges or syringes are held on the respective support, and/or b) irrespective of the sizes and/or nominal volumes of the containers held on the respective support.

Referring again to the drawings, the accommodating of a support 22 in a transport and packaging container 10 in a nested packaging concept provided according to the present invention will be described with reference to FIG. 4A. According to FIG. 4A, the transport and packaging container 10 is a substantially box or trough shaped design and has a bottom 11, a side wall 12 which protrudes therefrom perpendicularly or slightly inclined and is of encircling design, a step 13 protruding substantially at a right angle from the latter, an upper side wall 14 of encircling design and an upper edge 15 which is designed in the manner of a flange. The upper side wall 14 can be formed inclined by a small angle of inclination with respect to the perpendicular to the floor 11 in order to facilitate the introduction of the holding structure 20. A transport and packaging container 10 of this type may be formed from a plastic, in particular by plastic injection molding technology, and may be formed from a clear transparent plastic in order to permit an optical visual inspection of the holding structure 20 accommodated in the transport and packaging container 10 and an optical visual inspection of the containers held by the holding structure 20.

The support 20 is of overall flat design and has a plurality of openings 21 which are arranged in a regular arrangement, for example along rows and columns running perpendicularly thereto, in order to precisely predetermine the positions of containers on the support 20. The support 20 is supported here, according to FIG. 4A, on the step 13 of the transport and packaging container 10. At least two holding arms 23 are arranged on the edge of a respective opening 21, the holding arms 23 being configured in order to support the containers on the support 20 in a form fitting or frictionally locking manner. The holding arms 23 can be designed in particular in the manner as disclosed by U.S. Patent Application Publication No. 2015/0166212 A1, the entire contents of which are hereby incorporated herein by reference. The holding arms 23 can therefore hold the containers on the support 20 with radial play.

Figure 4A:
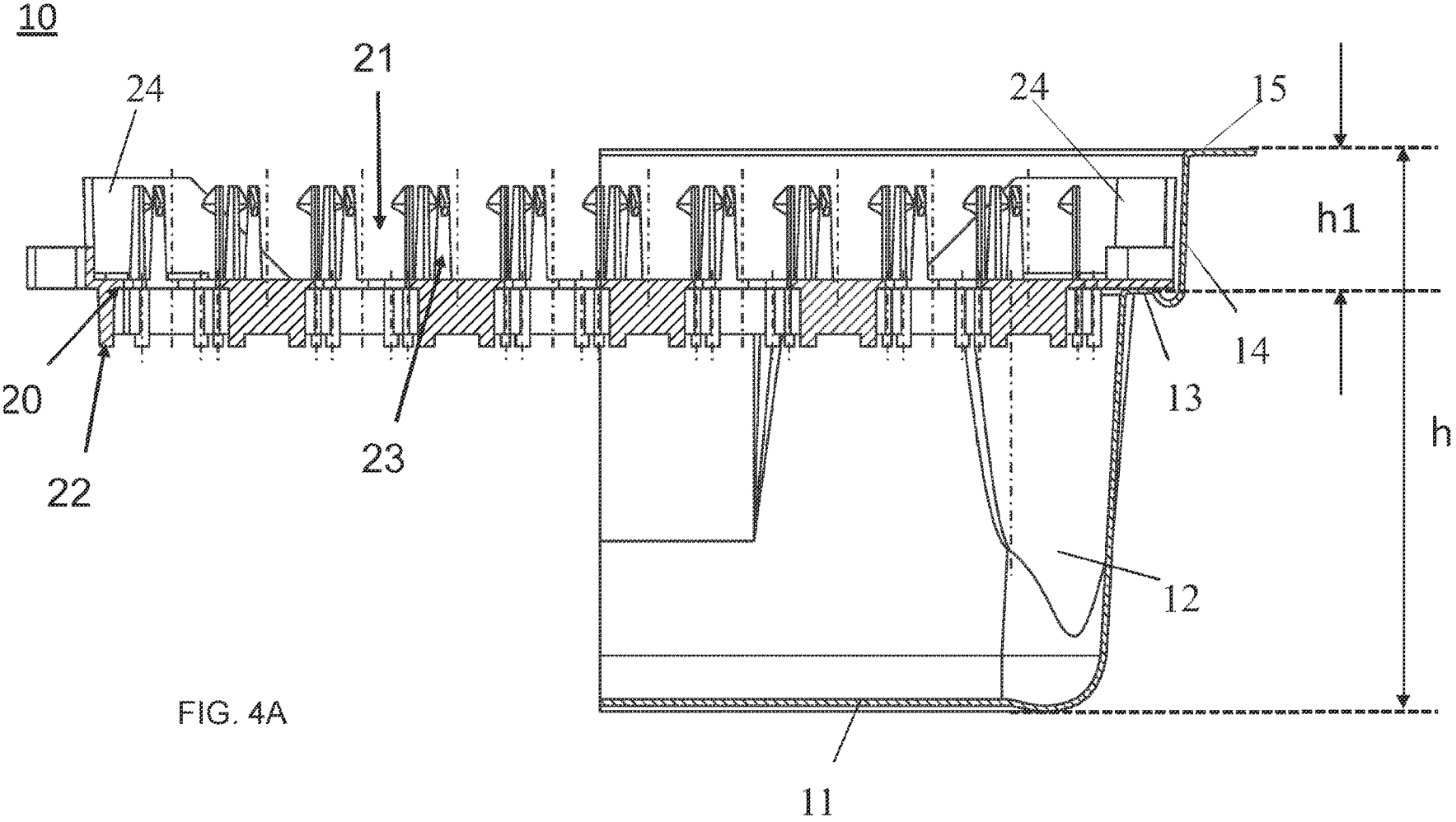
FIG. 4A illustrates a schematic partial section of the accommodating of a support in a transport and packaging container in a nested packaging concept provided according to the present invention.
Figure 4B:
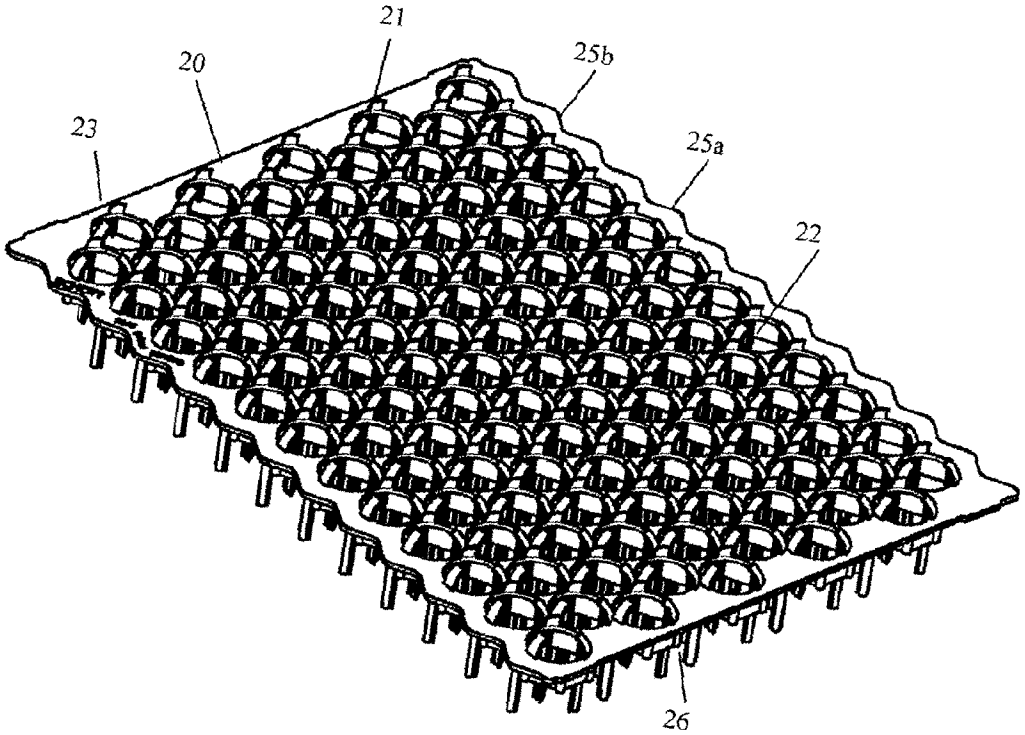
FIG. 4B illustrates a further example of a support for accommodating in a transport and packaging container in a nested packaging concept provided according to the present invention.

In FIG. 4A, the overall height of the transport and packaging container 10 is denoted by the reference sign "h" while the height of the upper side wall 14 is denoted by h1, and the height of the step 13 above the base 11, which may be referred to as a "step height," therefore corresponds to the difference h–h1. Due to this geometry of the transport and packaging container 10, the height of the containers (not shown), which are held on the support 20 and are accommodated in the transport and packaging container 10, is unambiguously defined.

The support 20 illustrated in FIG. 4A is suitable for holding vials. The height of the lower side wall 12 is dimensioned in such a manner that all types of vials which are marketable or are required by a pharmaceutical company can be accommodated in the same transport and packaging container 10 of the overall height h and do not project here beyond the upper edge 15 when the support 20 is supported on the step 13 of the transport and packaging container 10. In other words, the step height is constant and independent of the structure of held containers and the upper ends of held containers are held at a set height that is controlled by the step height to be less than the overall height h so the containers do not project beyond the upper edge 15. By adhesively bonding a sterile protective film onto the upper edge 15 of the transport and packaging container 10, the latter can be sealed in a sterile manner from the environment while the containers (not shown) therein are held on the support 20.

According to the present invention, the same type of transport and packaging container 10 having the same dimensions can be used for the sterile storage of pharmaceutical packages of different type (vials, cartridges or syringes) and different external dimensions, in particular different nominal volumes. Therefore, pharmaceutical packages of different type (vials, cartridges or syringes) and different external dimensions, in particular different nominal volumes, can optionally be stored in a sterile manner in a transport and packaging container 10 having standard dimensions and in packaging units having a comparable structure and delivered to a pharmaceutical company. If pharmaceutical packages of different type and/or having different geometries and/or heights or volumes are intended to be further processed, no complicated readjustment of the entire processing system is therefore required, according to the present invention, which makes flexible further processing of pharmaceutical packages of different types and/or dimensions possible. In particular, a constant height of the upper ends of the containers with the filling openings provided there can be ensured in a simple manner, and therefore an undesirable collision with filling needles or other filling devices for filling the containers with active substances can be reliably prevented.

For this purpose, depending on the desired use, a differently configured support can be arranged in the transport and packaging container, said support being configured for holding the respectively desired type of pharmaceutical packages and/or pharmaceutical packages having the respectively desired different geometries and/or heights.

Figure 4C:
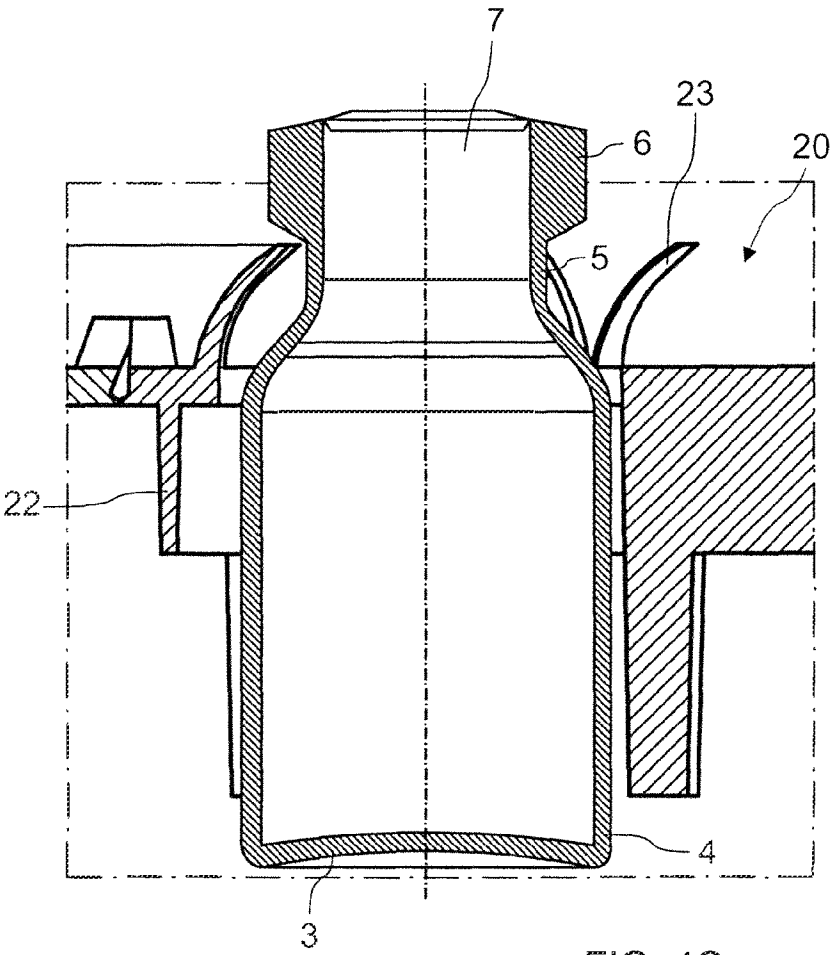
FIG. 4C illustrates an example for holding a container designed as a vial on a support for accommodating in a transport and packaging container in a nested packaging concept provided according to the present invention.

Examples for this purpose will be described further below with reference to FIGS. 4B to 4E, although the present invention is not intended to be expressly restricted thereto. According to FIG. 4B, elastic holding arms 23 are assigned to the openings 21 on the support 20 and hold a vial in the manner as shown in FIG. 4C. More precisely stated, the holding arms 23 extend radially inward and in each case support a vial below the widened upper edge 6 (what is referred to as a "rolled edge") with the filling opening 7. For the introduction of a vial into an opening and for the removal, the holding arms 23 have to be elastically expanded. Side walls 22 on the lower side of the support 20 prevent a collision of vials. For further details of the support, reference is made to the abovementioned U.S. Patent Application Publication No. 2015/0166212 A1, the contents of which are hereby expressly incorporated by reference.

Figure 4D:
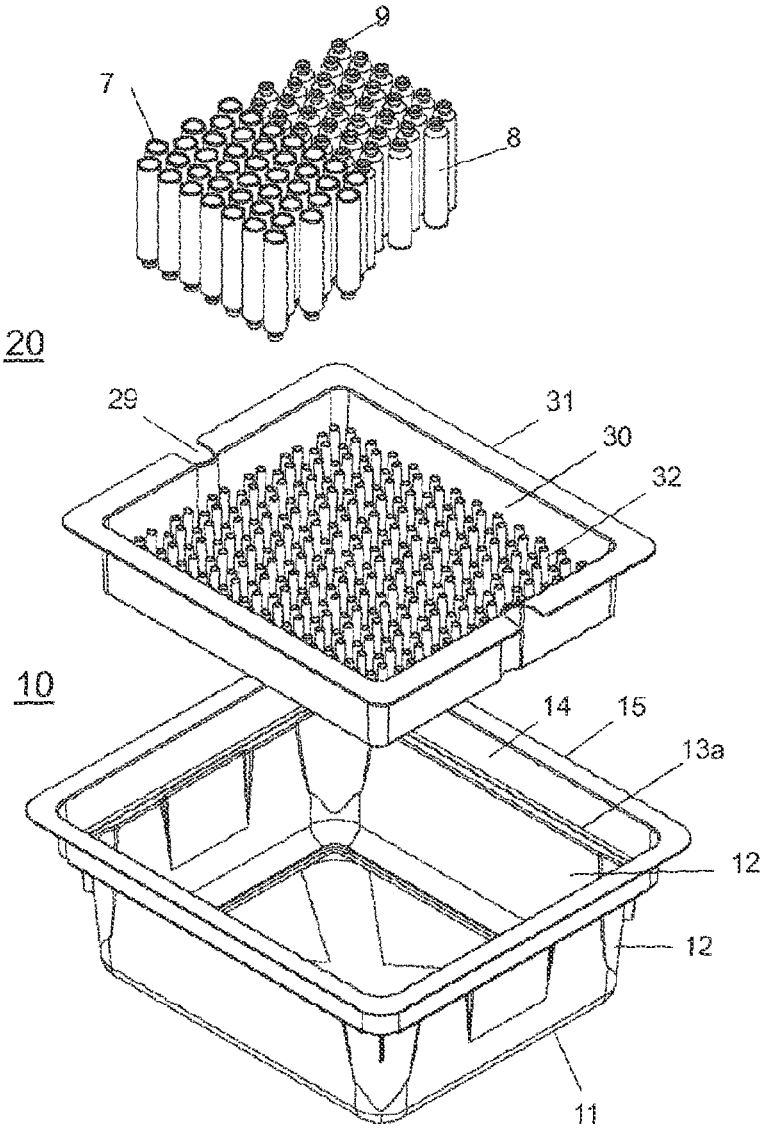
FIG. 4D illustrates a schematic perspective view of a transport and packaging container with a support in a nested packaging concept provided according to the present invention for storing a plurality of cartridges.

FIG. 4D shows a schematic perspective view of a transport and packaging container 10 with a support 20 in a nested packaging concept provided according to the present invention for storing a plurality of cartridges 8. The latter have an opening 7 at a first end for the filling and for the later receiving of a piston and a discharge opening at a second, opposite end that is conventionally closed with a stopper having a septum or the like which is axially secured at the second end by a metal cover 9, which is crimped on. Such precrimped cartridges 8 are basically known from the prior art.

According to FIG. 4D, the cartridges are held upside down on a support 20, which is disclosed in U.S. Patent Application Publication No. 2015/0122693 A1, the entire contents of which are hereby incorporated by reference. According to FIG. 4D, the support 20 is of overall trough shaped design and has a base, side walls 30 protruding vertically therefrom and an upper edge 31 which protrudes outward vertically from the upper side wall 30. A plurality of pins 32 are arranged on the base, between which receptacles are formed for receiving one cartridge 8 each. In the correct holding state, the crimped sections 9 protrude through openings in the base of the support 20. For the sterile storage of the cartridges 8 in the transport and packaging container 10, the upper edge 31 rests on the step 13*a* above the lower side wall 12. The height of the upper side wall 14 is coordinated here with the height of the upper side wall 30 of the support and the length of the cartridges 8 in such a manner that the cartridges 8 do not project beyond the upper edge 15 of the transport and packaging container 10.

Figure 4E:
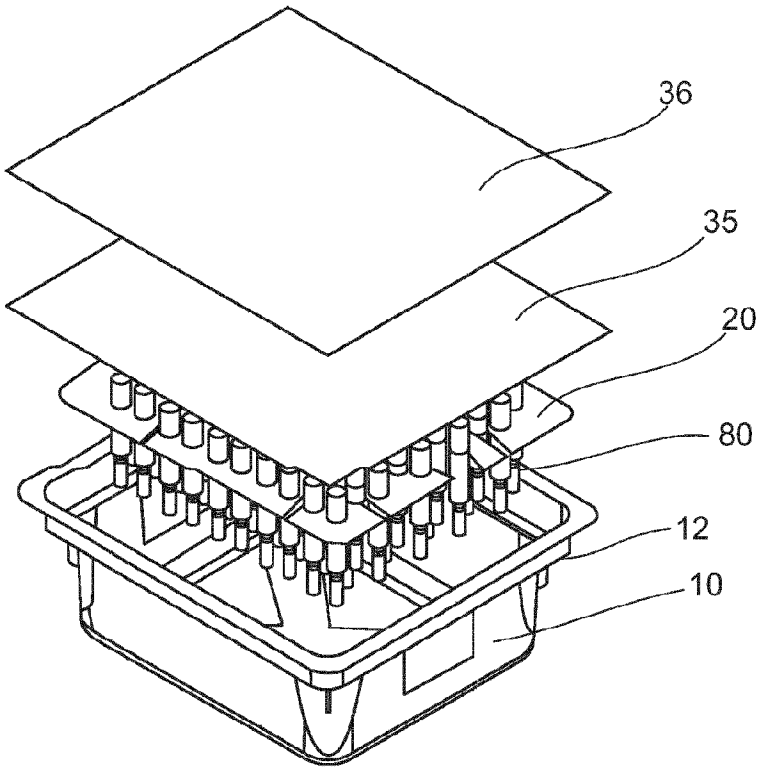
FIG. 4E illustrates a schematic perspective view of a transport and packaging container with a support in a nested packaging concept provided according to the present invention for storing a plurality of syringes.

FIG. 4E shows a schematic perspective view of a transport and packaging container 10 with a support 20 in a nested packaging concept provided according to the present invention for storing a plurality of syringes 80. Cylindrical receptacles which are suitable for this purpose, for receiving the syringes 80, are formed on the support 20. The height of the upper side wall 12 of the transport and packaging container 10 and the axial length of the cylindrical receptacles of the support 20 are coordinated with the length of the syringes 80 in such a manner that the syringes 80 do not project beyond the upper edge of the transport and packaging container 10.

For all three types of pharmaceutical packages, as explained above (vials, cartridges, syringes), a protective film, in particular a sterile protective film, for example a gas permeable plastics film, can be adhesively bonded onto the upper edge of the transport and packaging container, as shown in FIG. 4E. The protective film can be formed in particular from a mesh of plastics fibers, for example from polypropylene fibers (PP), or can be designed as a Tyvek® protective film which forms a sterile barrier. Between the protective film 36 and the support 20, an inlay film can be placed directly onto the upper ends of the containers in order to prevent an undesirable penetration of contaminants into the latter after the protective film is pulled off from the transport and packaging container.

In order to permit treatment or processing of the containers in a clean room, according to the present invention either vials, cartridges or syringes can be held on a support and stored in a sterile manner in a transport and packaging container and delivered to a pharmaceutical company. After the transport and packaging container is opened and the support or the container removed therefrom, the containers can be further processed according to the present invention without complicated readjustment of the processing system, wherein the overall height h of the transport and packaging containers (cf. FIG. 4A) and/or the height h1 of a step close to an upper edge of the transport and packaging containers can be kept constant, specifically irrespective of whether vials, cartridges or syringes are held on the respective support and are intended to be processed further, and/or irrespective of the sizes and/or nominal volumes of the containers held on the respective support.

Figure 4F:
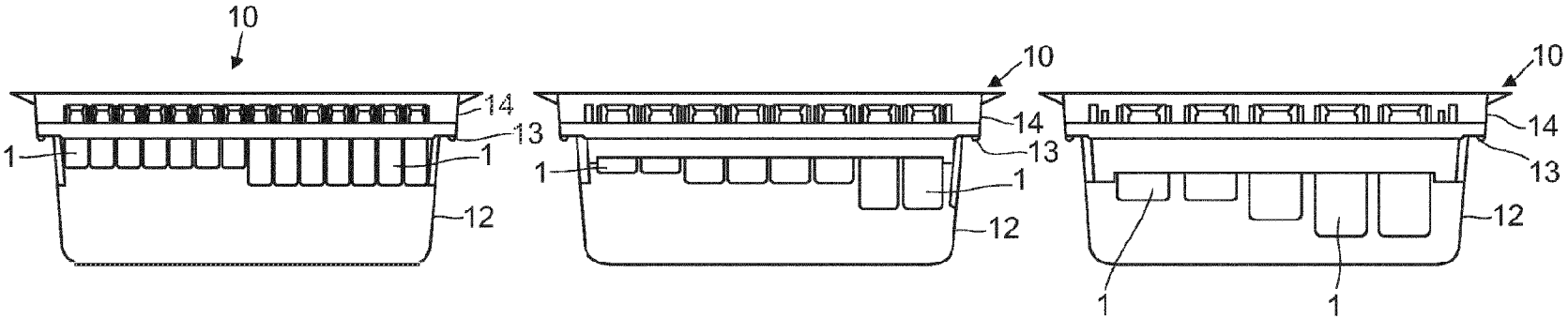
FIG. 4F illustrates a schematic view of the holding of vials having different nominal volumes in a transport and packaging container having constant dimensions.

FIG. 4F shows by way of the example of vials that, according to a further aspect of the present invention, optionally even containers having different sizes and/or nominal volumes can be stored in a transport and packaging container having constant dimensions and can be delivered to a pharmaceutical company. FIG. 4A schematically shows three different situations. The left transport and packaging container 10 accommodates a support 20 on which vials 1 having two different sizes and/or nominal volumes are held with the aid of the holder provided on the support 20. Vials 1 having two different sizes and/or nominal volumes are held on the support 20 in the central transport and packaging container 10, said vials being larger in comparison to the left transport and packaging container 10. Vials 1 having two different sizes and/or nominal volumes are held on the support 20 in the right transport and packaging container 10, the vials once again being larger in comparison to the central transport and packaging container 10. The height of the lower side wall 12 is coordinated with the sizes and/or nominal volumes of the containers 1 in such a manner that the upper ends of the containers 1 with the filling openings provided there are always arranged at the same height—relative to the base of the transport and packaging container 10 or a working surface. The containers 1 are always completely accommodated here in the respective transport and packaging container 10. A complicated readjustment of the height positions of filling needles or comparable filling devices for filling the containers 1 is therefore unnecessary according to the present invention.

FIG. 4F is based on the fact that the dimensions of the transport and packaging container 10 are configured in such a manner that all commercially available types of containers 1 of a manufacturer of said containers can be held on a support 20 and can be completely accommodated in the transport and packaging container 10 without protruding over the upper edge of same. The support 20 and the transport and packaging container 10 are therefore suitable for holding and for accommodating all containers having different sizes and/or nominal volumes. Commercially available ISO vials for storing substances for medical, pharmaceutical or cosmetic uses are sold, for example, in the size range of 2R to 30R (corresponding to a nominal volume within the range of between 4 ml and 37.5 ml) or in the size range of 2R to 50R (corresponding to a nominal volume within the range of between 4 ml and 62.23 ml), which corresponds to an overall height of the vials within the range of between 35 mm and 75 mm or within the range of between 35 mm and 73 mm in the European market or to an overall height of the vials within the range of between 32 mm and 76 mm or within the range of between 32 mm and 65 mm in the U.S. market. Within the context of the present application, the overall height h (cf. FIG. 4A) of the transport and packaging container 10 is configured in such a manner that all types of containers can be completely accommodated therein. In order to accommodate commercially available ISO vials within the size range of 2R to 30R or within the size range of 2R to 50R, the overall height h of the transport and packaging container 10 should therefore be, for example, approximately 97 mm.

FIG. 4F is based on the fact that the upper ends of containers having different sizes and/or nominal volumes are always of identical design, i.e., with a same height of the neck and shoulder section 5 (cf. FIG. 4C) and of the widened upper edge. In the event that the upper ends of containers having different sizes and/or nominal volumes are intended to have different geometries, in particular different heights, this can be compensated for in a simple manner according to the present invention by specific adaptation of the holder of the supports 20, and therefore transport and packaging containers 10 having the same dimensions and the same geometry can always be used even for containers 1 having different sizes and/or nominal volumes.

A processing system for treating and processing a plurality of containers in a nested packaging concept provided according to the present invention will be described in more detail below with reference to FIGS. 5 and 6.

The processing system which is denoted overall by 50 has a sterile internal volume 58 with a loading section on the left side and an outlet section on the right side thereof. For the processing, packaging units, as described previously, are supplied to the sterile internal volume 58 via the loading section. In more precise terms, the packaging bags 18 made of plastic are introduced into an anteroom 51, which can already be a clean room, for example a clean room of a low clean room class. The packaging bags 18 are placed onto a conveyor device 60, for example a transport belt, and conveyed in the direction specified by the arrow toward the clean room 57. Since the transport and packaging container 10 is accommodated loosely in the packaging bag 18, first of all, in the station AA, the upper side of the packaging bag 18 has to be tightened and pressed down such that the plastic of the packaging bag 18 rests directly on the sterile protective film 19 or on the upper edge of the transport and packaging container 10. The packaging bag 18 is then split open at the positions BB and the transport and packaging container 10 is introduced via the material lock 53 into a decontamination region 54 in which the outer side of the transport and packaging container 10, in particular the region of the protective film 19, is freed from germs, etc. by a decontamination device 55, for example by electron beams. The packaging bag 18 therefore does not need to be sterile, but rather can be configured as a simple dustproof packaging unit, i.e., as a packaging unit without a sterile barrier. The transport and packaging container 10 is subsequently transferred via a further material lock 56 into the clean room 57 in which, after the protective film 19 is removed, the containers are actually further treated or processed by the processing device 58. During the further processing in the clean room 57, the containers may be held on the support 20, as shown in FIG. 5, which shows further details of the further processing of the containers in the clean room 57.

After removal of the protective films of the packaging units, the transport container and nest arrangements ("tub and nest") which accommodate presterilized containers are finally arranged in the vicinity of the loading position, which is denoted by reference sign 70. For the further processing, the transport container and nest arrangements are conveyed by the conveyor device 60 along the direction of the arrow in FIG. 5 until finally the discharge position is reached, which is denoted by the reference sign 77. For the conveying of the supports, the latter can be accommodated in a holding frame 72, or the transport containers (tubs) which each accommodate a nest are accommodated in a holding frame 71 or comparable holding stages. In each case, the upper ends of the containers are always supplied to the processing stations 75, 76 at exactly predetermined height levels, specifically irrespective of the respective type of container, i.e., irrespective of whether vials, cartridges or syringes are intended to be filled and further processed.

Figure 5:
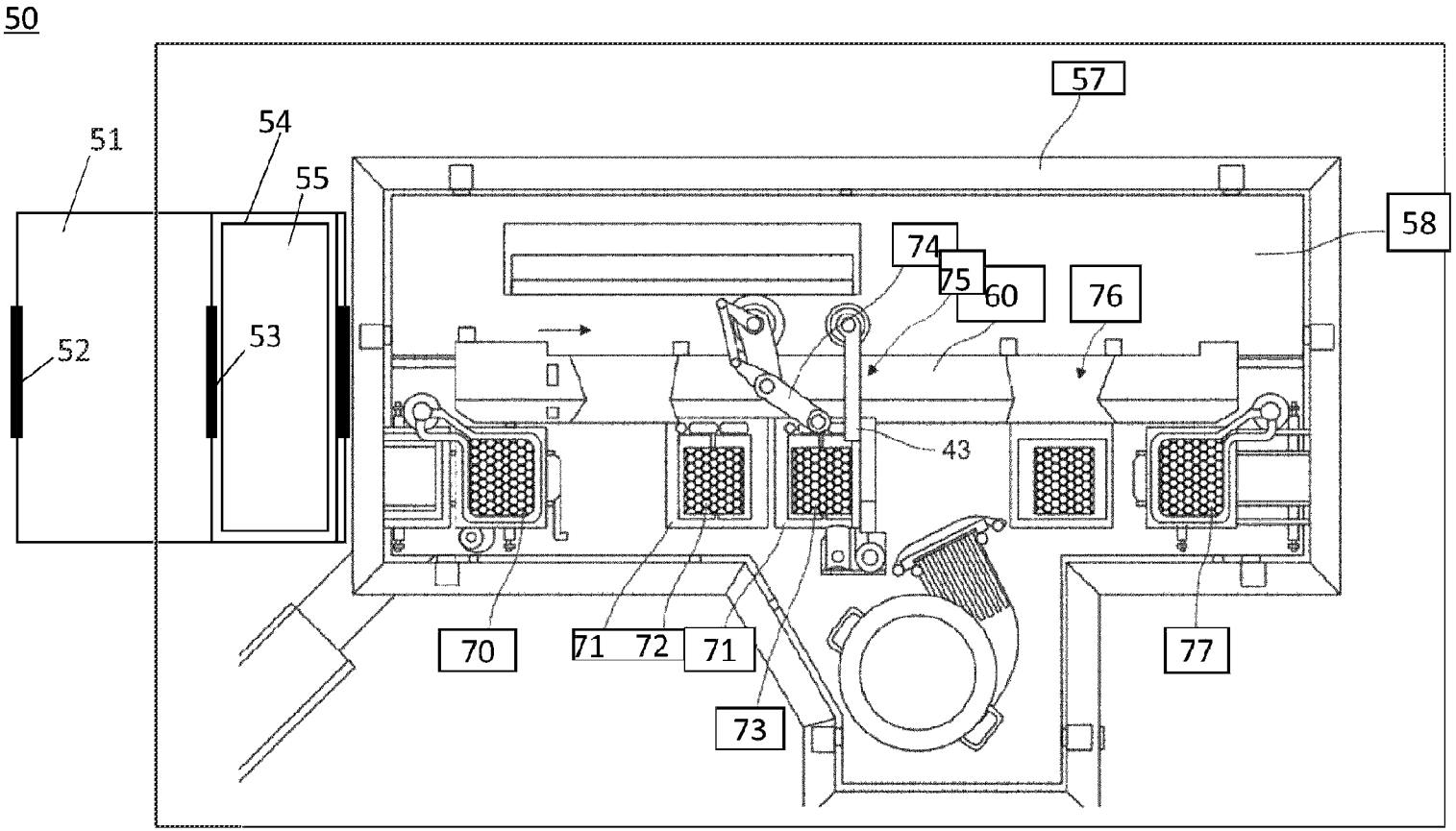
FIG. 5 illustrates a schematic top view of a processing system for treating and processing a plurality of containers in a nested packaging concept provided according to the present invention.

As an example of a process step, FIG. 5 shows the filling of containers which are accommodated in nests in the holding frame 71. For the filling, the nests are first of all conveyed to the waiting position 72 and then to the filling and closure station 75 where the filling is carried out generally line by line. After the filling and closing of the containers, the nests which hold the filled and closed containers, or the transport container and nest arrangements which accommodate the filled and closed containers, are finally conveyed to the discharge position which is denoted by the reference sign 77.

Figure 6:
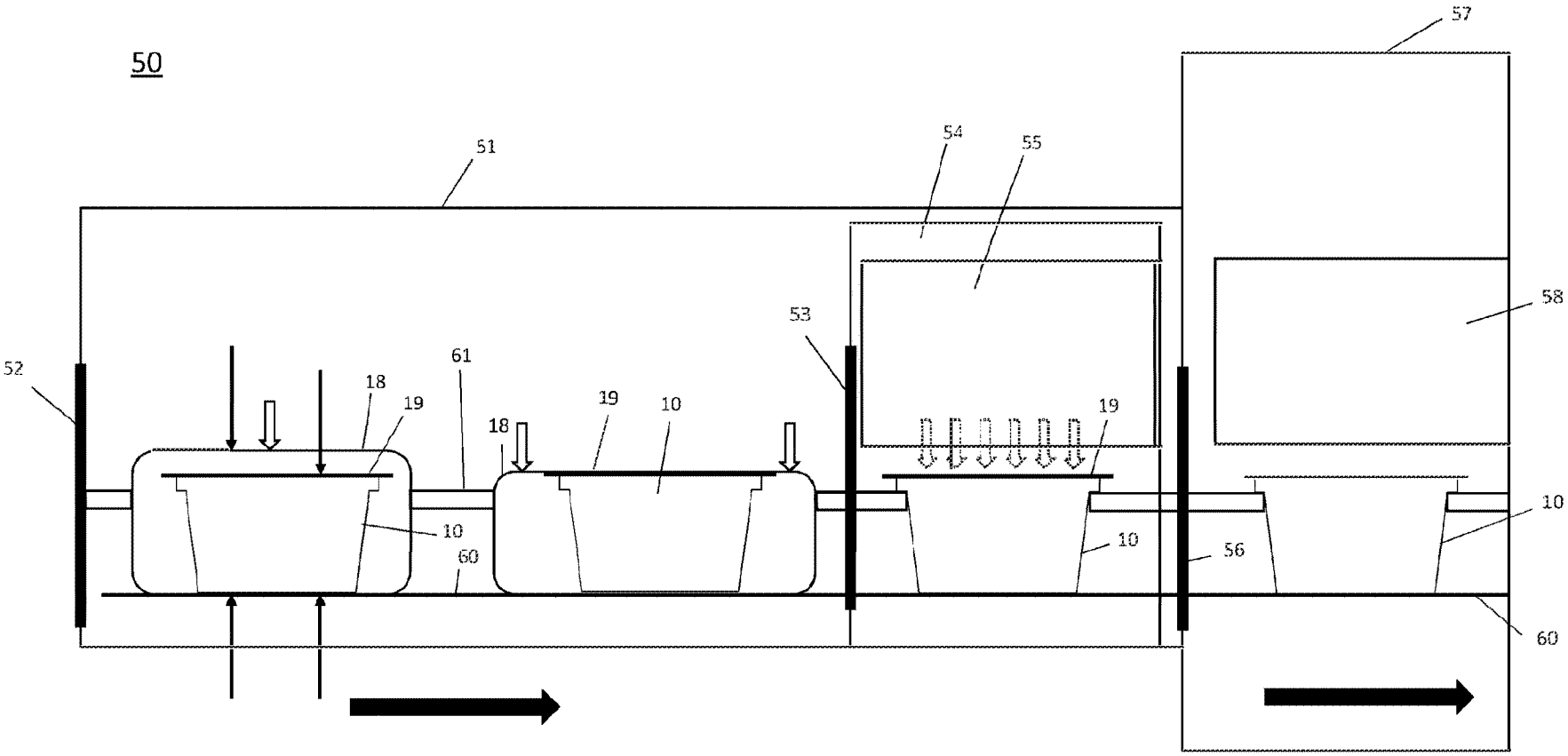
FIG. 6 illustrates a schematic illustration of the treatment and processing of a plurality of containers in the processing system provided according to FIG. 5.

During the treatment or processing of the containers, the transport and packaging containers or supports are guided laterally or vertically at least in phases by guide devices 61, as shown in FIG. 6. These can be guide strips 61 which are arranged at least in sections above and to the side of a transport belt 60 in the anteroom 51 and clean room 57. In particular, for this purpose, the bottoms, side walls 12, 14 or steps 13 (cf. FIG. 4A) of the transport and packaging containers are guided laterally or vertically.

According to some embodiments, the overall height h of a transport and packaging container 10 (cf. FIG. 4A) lies within a range of between 51 mm and 97 mm if a plurality of vials is held in the transport and packaging container 10 on the support 20. The support here can have a length within the range of 229 mm or 230 mm to 238 mm and a width within the range of 189 to 199 mm.

According to some embodiments, the overall height h of a transport and packaging container 10 (cf. FIG. 4D) lies within a range of between 88 mm and 97 mm if a plurality of cartridges, in particular precrimped cartridges, is held in the transport and packaging container 10 on the support 20. The support here can have a length within the range of 229 mm or 230 mm to 238 mm and a width within the range of 189 to 199 mm.

The abovementioned exemplary dimensions are important for the further processing in currently commercially available clean room installations in the pharmaceutical industry.

For the processing of pharmaceutical packages, all the stages of a processing system conventionally have to be qualified and validated. This relates in particular to the installation of the processing system ("installation qualification"), the operator control behavior of the processing system ("operator action qualification") and the operating behavior of the process system ("performance qualification") and requires a multiplicity of examinations and generally written evidence of the documentation. Since, according to the present invention, transport and packaging containers having standard dimensions and geometries and packaging units having a standard design and standard dimensions and geometries can be used for different types of pharmaceutical packages (in particular vials, cartridges and syringes), no new qualification and validation is required. Handling devices, material locks, etc. of a processing system only need to be set up once and certified, according to the present invention, and therefore the treatment or processing of pharmaceutical packages is configured according to the present invention to be very flexible.

According to the present invention, the outlay for the standard guidance and for the holding of the transport and packaging containers and supports is also very much smaller.

While conventionally processing systems have had to have different conveying paths for different types of pharmaceutical packages, according to the present invention one and the same processing system can be used for treating or processing pharmaceutical packages of different type and/or of different geometry/dimensions or nominal volumes without a complicated readjustment of components of the processing system being required for this purpose. In particular, according to the present invention, one and the same filling line can be used for filling pharmaceutical packages of different type and/or of different geometry/dimensions without a complicated readjustment of components of the processing system being required for this purpose. In particular, according to the present invention, a complicated readjustment of the height position of filling needles or comparable filling devices for filling the containers can be avoided.

From the foregoing, it should be appreciated that a method of filling pharmaceutical containers is also provided according to the present invention. The method includes filling a first plurality of containers with a filling device. The first plurality of containers, which may include vials, cartridges, and/or syringes, are supported by a first holder, which is supported on a first step defining a first step height. Filling the first plurality of containers includes moving a plurality of filling needles of the filling device to a filling needle height and dispensing a substance from the filling needles into each of the first plurality of containers. The method further includes filling a second plurality of containers with the filling device. The second plurality of containers, which differ from the first plurality of containers in at least one aspect including a size, a shape, and/or a type, are supported by a second holder supported on a second step of a second transport and packaging container. The second step defines a second step height that is equal to the first step height. Filling the second plurality of containers includes moving the filling needles to the same filling needle height that is used to fill the first plurality of containers and dispensing the substance from the filling needles into each of the second plurality of containers. Upper ends of the first plurality of containers and upper ends of the second plurality of containers may each be held at a same set height during filling, allowing the filling needles to dispense substance into both the first plurality of containers and the second plurality of containers while being held at the filling needle height. It should thus be appreciated that exemplary embodiments provided according to the present invention allow for a wide variety of containers to be filled by a filling device without having to adjust the filling procedure, which can result in a substantial savings in time and cost.

Also considered over the product cycle of medicaments, one and the same processing system can be flexibly used for treating or processing pharmaceutical packages in the different phases of a medicament (clinical trials, introduction onto the market in low piece numbers, mass production in large batches), without a complicated readjustment of components of the processing system being required for this purpose. Even a just in time production and decanting of very high quality medicaments, for example for gene therapy, or of variable doses is easily possible according to the present invention without a complicated readjustment of components of a processing system being required for this purpose.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE SIGNS

1 Vial
3 Bottom
4 Side wall
5 Neck section
6 Widened upper edge
7 Filling opening
8 Cartridge
80 Syringe
9 Crimped section with discharge opening
10 Transport and packaging container
11 Bottom
12 Lower side wall
13 Step
13*a* Step/depositing surface
14 Upper side wall
15 Upper edge
18 Sterile packaging bag
19 Sterile protective film
20 Holding structure/support
21 Opening

22 Side wall
23 Holding arms
24 Upper side wall
25*a* Projection
25*b* Recess
26 Pin/spacer
29 Access opening
30 Side wall
31 Edge/projection
32 Pin/cylinder
35 Inlay film
36 Sterile covering film
50 Processing system
51 Anteroom
52 Material lock
53 Material lock
54 Decontamination region
55 Decontamination device
56 Material lock
57 Clean room
58 Processing device
60 Conveyor device
61 Guide device
70 Transport container and nest arrangement on loading section
71 Holding frame
72 Nest arrangement in waiting position
73 Nest arrangement at filling station
74 Adjustable arm with filling needles
75 Processing station for filling and closing
76 Downstream processing station
77 Transport container and nest arrangement at discharge section
AA Station for pressing down sterile packaging bag 18
BB Station for opening sterile packaging bag 18
CC Station for irradiating transport and packaging container 10
H, h1 Heights
PRIOR ART
100 Transport and packaging container
101 Upper side wall
101*a* Step
102 Upper edge
103 Sterile protective film
104 Sterile packaging bag
110 Processing system
111 Anteroom
112 Material lock
113 Material lock
114 Decontamination region
115 Decontamination device
116 Material lock
117 Clean room
118 Processing device
120 Conveyor device
121 Guide device
A Station for pressing down a sterile packaging bag 104
A Station for opening a sterile packaging bag 104
C Station for irradiating a transport and packaging container 100
H1, H1', H2, H2' Heights

What is claimed is:

1. A method of filling pharmaceutical containers, comprising:

filling a first plurality of containers with a filling device as the first plurality of containers are supported by a first holder supported on a first step of a first transport and packaging container, the first step defining a first step height, filling the first plurality of containers comprising moving a plurality of filling needles of the filling device to a filling needle height and dispensing a substance from the filling needles into each of the first plurality of containers simultaneously; and filling a second plurality of containers with the filling device as the second plurality of containers are supported by a second holder supported on a second step of a second transport and packaging container, the second step defining a second step height that is equal to the first step height, filling the second plurality of containers comprising moving the filling needles to the filling needle height and dispensing the substance from the filling needles into each of the second plurality of containers simultaneously, the second plurality of containers differing from the first plurality of containers in at least one aspect comprising at least one of a size, a shape, or a type, wherein the first transport and packaging container and the second transport and packaging container each define a respective overall height within a range of between 51 mm and 97 mm, wherein at least one of the first holder or the second holder has a length within a range of 229 mm to 238 mm.

2. The method of claim 1, wherein upper ends of the first plurality of containers are each held at a set height in the first transport and packaging container and upper ends of the second plurality of containers are each also held at the set height in the second transport and packaging container.

3. The method of claim 1, wherein the first transport and packaging container defines a first overall height and the second transport and packaging container defines a second overall height that is equal to the first overall height.

4. The method of claim 3, wherein upper ends of the first plurality of containers are each held at a set height in the first transport and packaging container and upper ends of the second plurality of containers are each also held at the set height in the second transport and packaging container independent of at least one of a shape, a type, or a size of each of the held containers.

5. The method of claim 4, wherein the set height is less than the first overall height and the second overall height.

6. The method of claim 3, wherein the first step is placed between a pair of sidewalls of the first transport and packaging container and the second step is placed between a pair of sidewalls of the second transport and packaging containers.

7. The method of claim 6, wherein the pair of sidewalls of the first transport and packaging container and the pair of sidewalls of the second transport and packaging container each comprise an upper sidewall and a lower sidewall that is connected to the upper sidewall, the upper sidewall defining a sidewall height, the first step height being equal to a difference between the first overall height and the sidewall height and the second step height being equal to a difference between the second overall height and the sidewall height.

8. The method of claim 7, wherein the first step and the second step each connect the lower sidewall to the upper sidewall of the respective transport and packaging container.

9. The method of claim 1, wherein a processing station comprises the filling device, the method further comprising conveying the first plurality of containers to the processing station with a conveyor device and conveying the second plurality of containers to the processing station with the conveyor device.

10. The method of claim 1, wherein the first packaging and transport container and the second transport and packaging container are each packaged in a packaging unit prior to filling the first plurality of containers and filling the second plurality of containers, the method further comprising opening the packaging unit and removing the first packaging and transport container and the second transport and packaging container from the packaging unit prior to filling the first plurality of containers and filling the second plurality of containers.

11. The method of claim 10, further comprising removing a protective film from the packaging unit prior to removing the first packaging and transport container and the second transport and packaging container from the packaging unit.

12. The method of claim 1, wherein the substance comprises a substance for medical, pharmaceutical, or cosmetic uses.

13. The method of claim 1, wherein the first packaging and transport container and the second transport and packaging container are each of a box shaped design.

14. The method of claim 1, wherein the second plurality of containers each have a different size than each of the first plurality of containers.

15. The method of claim 1, wherein the second plurality of containers each have a different shape than each of the first plurality of containers.

16. The method of claim 1, wherein the second plurality of containers are of a different type than each of the first plurality of containers.

17. The method of claim 1, wherein the first transport and packaging container and the second transport and packaging container both have the same dimensions and the same geometry.

18. The method of claim 1, wherein the first plurality of containers are each held in a respective one of a first plurality of holder openings of the first holder and the second plurality of containers are each held in a respective one of a second plurality of holder openings of the second holder, wherein at least one of the first holder or the second holder comprises at least two elastic holding arms assigned to each of the respective holder openings and configured to support a container in their respectively assigned holder opening.

19. The method of claim 1, wherein at least one of the first holder or the second holder has a width within a range of 189 mm to 199 mm.

20. The method of claim 1, wherein the first plurality of containers comprises a first plurality of cartridges supported upside down in the first holder and the second plurality of containers comprises a second plurality of cartridges supported upside down in the second holder, each of the second plurality of cartridges having a different size or shape from each of the first plurality of cartridges.

* * * * *